US005158382A

United States Patent [19]

Baron et al.

[11] Patent Number: 5,158,382

[45] Date of Patent: Oct. 27, 1992

[54] INTEGRAL LOCKING DEVICE FOR A TYPEWRITER

[75] Inventors: Robert J. Baron, Cortland; Donald G. Anderson, Jr., Locke, both of N.Y.

[73] Assignee: Smith Corona Corporation

[21] Appl. No.: 818,578

[22] Filed: Jan. 9, 1992

[51] Int. Cl.[5] ..... B41J 29/56

[52] U.S. Cl. ..... 400/663; 400/664; 400/674; 400/223; 400/236.1

[58] Field of Search ..... 400/663, 668, 674, 670.2, 400/670.3, 191, 223, 236.1, 665, 666, 675, 664

[56] References Cited

U.S. PATENT DOCUMENTS

| | | | |
|---|---|---|---|
| 657,153 | 9/1900 | Barron | 400/668 |
| 1,677,210 | 7/1928 | Rose | 400/663 |
| 1,699,061 | 1/1929 | Garbell | 400/674 |
| 3,239,051 | 3/1966 | Morris et al. | 400/674 |
| 4,403,879 | 9/1983 | Vought et al. | 400/674 |
| 4,411,542 | 10/1983 | Wendroth et al. | 400/236.1 X |
| 4,773,773 | 9/1988 | Itoh | 400/674 X |
| 4,808,020 | 2/1989 | Kudo | 400/674 X |
| 4,886,383 | 12/1989 | Mueller | 400/208 |
| 4,886,385 | 12/1989 | Cappotto | 400/234 |
| 5,039,232 | 8/1991 | Kerzel et al. | 400/663 X |

FOREIGN PATENT DOCUMENTS

| | | | |
|---|---|---|---|
| 0154975 | 7/1986 | Japan | 400/674 |
| 0090280 | 4/1987 | Japan | 400/674 |

OTHER PUBLICATIONS

IBM Technical Disclosure Bulletin, vol. 28, No. 7 Dec. 1985.

*Primary Examiner*—Edgar S. Burr
*Assistant Examiner*—Christopher A. Bennett

[57] ABSTRACT

An integral locking device for a typewriter is used to safeguard against damages and to prevent a correction ribbon from feeding when the typewriter is transported. The integral locking device locks a carrier in a predetermined channel position, locks the correction bail on the carrier to prevent correction ribbon feed, and jams a correction ribbon feed release device.

29 Claims, 6 Drawing Sheets

INTEGRAL LOCKING DEVICE FOR A TYPEWRITER

BACKGROUND OF THE INVENTION

The present invention relates to typewriter locking devices, used to safeguard against damages and prevent correction ribbon feed when a typewriter is transported. Specifically, this invention concerns an integral locking device for a typewriter, having a moveable carrier, to be used during transport of the typewriter, which locks the carrier in a predetermined channel position, locks the correction ribbon bail on the carrier, and jams a correction ribbon release device.

2. Description of Related Art

Prior art teaches diverse typewriter locking devices used to safeguard against damage when a typewriter is transported. Vought et al. 1983 (U.S Pat. No. 4,403,879), teaches a complex and involved moveable carrier locking device, used to safeguard against damages when a typewriter is transported. The invention prevents shifting of the carrier at a predetermined position, by locking the carrier on a typewriter base frame. Two blades pivotally mounted on the base frame engage the underside of the carrier, thus locking the carrier in a predetermined position. The predetermined position is a point at which a sensor, and a plate on the carrier meet. The meeting allows a user to slide a switch, thereby, pivoting the blades to lock the carrier, and also shutting off electrical power to the electrically driven carrier.

Vought et al., however, is complex, involving numerous blades, points of engagement, fingers, members, mounts, and wires, as well as, involving electricity. Furthermore, the user needs to locate the predetermined position, the meeting of the sensor and the plate, before he may lock the carrier. Such a requirement may be time-consuming and frustrating. Vought et al., also does not teach a device to lock a correction bail on the carrier and/or jam a correction ribbon releasing device on the correction bail. Lastly, Vought et al.,s predetermined locking position is difficult to change as the majority of the locking mechanism is mounted on, or interact with, parts which are mounted on the base frame of the typewriter.

Garbell, 1929 (U.S. Pat. No. 1,699,061), and Rose, 1928 (U.S. Pat. No. 1,677,210), teach carriage locking devices as opposed to carrier locking devices, to protect against shocks and strains occasioned during transport. Garbell's device, also moves a rack bar off the carriage, further preventing longitudinal movement of the carriage. Garbell like Vought et al., however, teaches a relatively immutable locking position, because the actuating key member can only reside in a few areas of the keyboard. Furthermore, Garbell's device does not interact with a moveable carrier, and other devices common to modern typewriters.

Rose, like Garbell, teaches disconnecting a carriage moving mechanism in order to lock the carriage. Rose teaches a lever, which disconnects the carriage moving mechanism from the carriage, and is positioned so that, when a user covers the typewriter with a cover, the cover engages the lever. In addition, Rose teaches a moveable carriage, which can only be locked in a central position for transport, and does not address locking a correction bail.

Barron, 1900 (U.S. Pat. No. 657,153), teaches a device which locks ribbon feed after a predetermined amount of ribbon is unwound. Barron does not teach locking a correction bail. Furthermore, Barron teaches direct interaction with the ribbon, an inefficient and possibly damaging method of restraining the ribbon.

A common practice in the art is to place a rubber band over the top of a correction bail to prevent correction ribbon feed during transport. The rubber band holds down the correction bail preventing the correction bail from pivoting up and down, thereby, preventing the correction ribbon from feeding. This common practice, however, has several drawbacks. First, the rubber band is often difficult to remove from the correction bail, as one needs to reach underneath the carrier in order to stretch and pull the rubber band off the carrier and correction bail. Secondly, a rubber band sometimes loosens during transport, and therefore, cannot prevent the correction bail from pivoting up and down.

A correction ribbon feed mechanism which feeds correction ribbon in response to the correction bail pivoting up and down is disclosed in U.S. Pat. No. 4,886,383 dated Dec. 12, 1989, invented by Hans W. Mueller and assigned to Smith Corona Corporation.

SUMMARY OF THE INVENTION

A novel integral locking device for a typewriter, having a moveable carrier and a correction bail, pivotally mounted on the carrier, used to safeguard against damages and prevent correction ribbon feed when the typewriter is transported, which locks the carrier in a predetermined channel position, locks the correction ribbon bail on the carrier, and jams a correction ribbon feed release device on the correction bail.

It is therefore an object of the present invention to disclose a novel apparatus for locking a typewriter, to be used to safeguard against damages when the typewriter is transported.

It is another object of the present invention to disclose a novel and improved carrier locking device, to be used during transport of a typewriter.

It is another object of the present invention to disclose a novel and improved device for locking a correction bail on a carrier for preventing correction ribbon feed during transport.

It is yet another object of the present invention to disclose a novel device for jamming a correction ribbon feed release device on a correction bail for preventing correction ribbon feed during transport.

Further objects of the invention will be set forth in the description which follows, and will become apparent to those skilled in the art upon examination of the specifications or by practice of the invention.

DETAILED DESCRIPTION OF THE INVENTION

Figure 1:
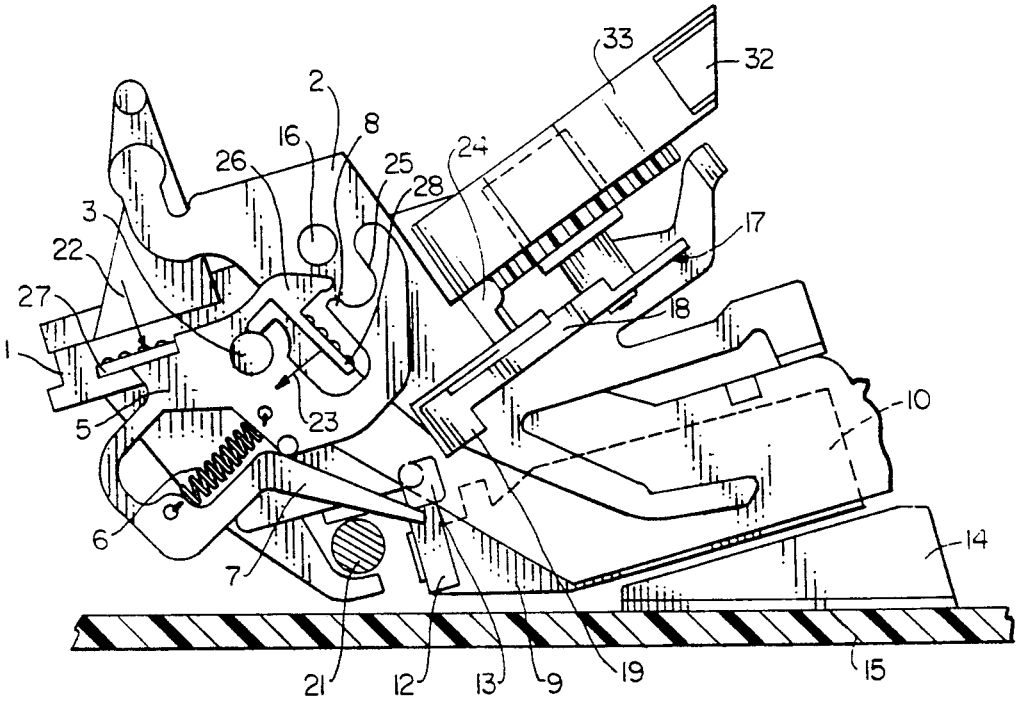
FIG. 1 is a right side elevation view of a carrier, showing an integral locking device built in accordance with the teachings of the present invention, in its resting position, and a correction ribbon on the correction bail.
Figure 4:
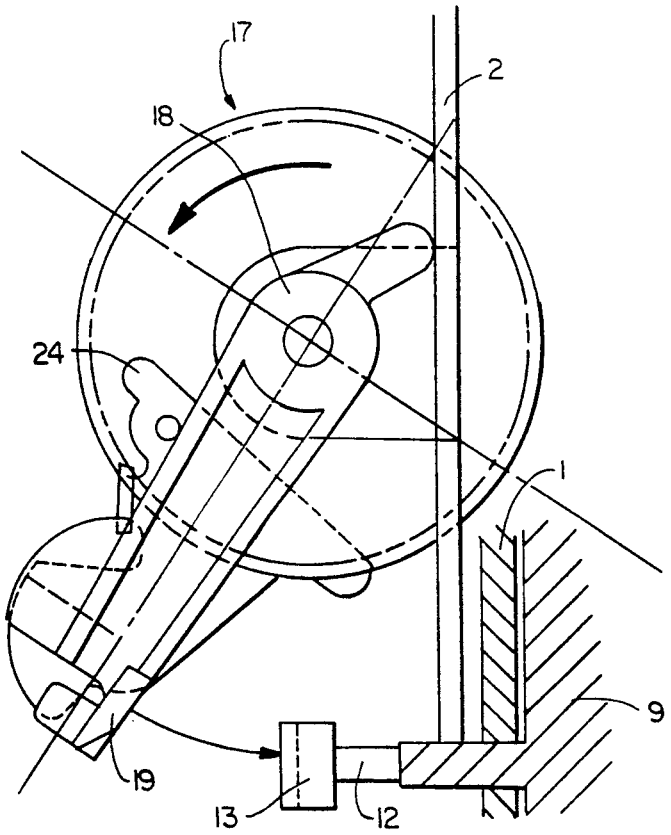
FIG. 4 is an underside view of the correction ribbon feed releasing device, and a blocking pawl feature of the carrier restraint beam means arm.

The disclosed invention, an integral locking device for a typewriter, having a moveable carrier (I) (see FIG. 1) and a correction bail (2), pivotally mounted on the carrier (I), to be used during transport of the typewriter, which locks the carrier (1) in a predetermined channel position, locks the correction bail (2),and jams a correction ribbon feed release device (I7) on the correction bail (2), in its preferred embodiment, comprises the parts of: a. pivot post (3) on the carrier (I), b. a pivot spring (4) (see FIGS. 6*a*, 6*b*, and 6*c*) attached to the carrier (I), c. a correction bail restraint means (5) (see FIG. 1), pivotally mounted on the post (3), including two tabs, "a" (27) and "b" (28), a spring (6), a flexible spring arm (7), and a latch (8), d. a carrier restraint beam means (9) (see FIGS. 6*a*, 6*b*, and 6*c*), pivotally attached by the pivot spring (4) to the carrier (1), including an abutment end (10), a pivot spring eye pin (11) attached to the pivot spring (4), and an arm (12) and a blocking pawl feature means (13) on the arm (12) on the other end, e. a base pan locking channel feature (14) with ramping means (31) and a channel (30) (see FIG. 5), attached to a typewriter base structure (15) at a predetermined location, f. a stud (16) (see FIG. 1) on the correction bail (2) of the carrier (1), and g. a correction ribbon feed releasing device (17), on the correction bail (2) including a tension pawl carrier (18) (see FIG. 4) with a blocking abutment (19) and a tension pawl (24) on a tension pawl carrier (18).

It is apparent to a person skilled in the art, that the pivot post (3) (see FIG. 1) on the carrier (1) may be replaced by a journal on the carrier, and a correction bail restraint means (5) with a pivot pin can pivot in the journal, locking the correction bail (2).

Figure 2:
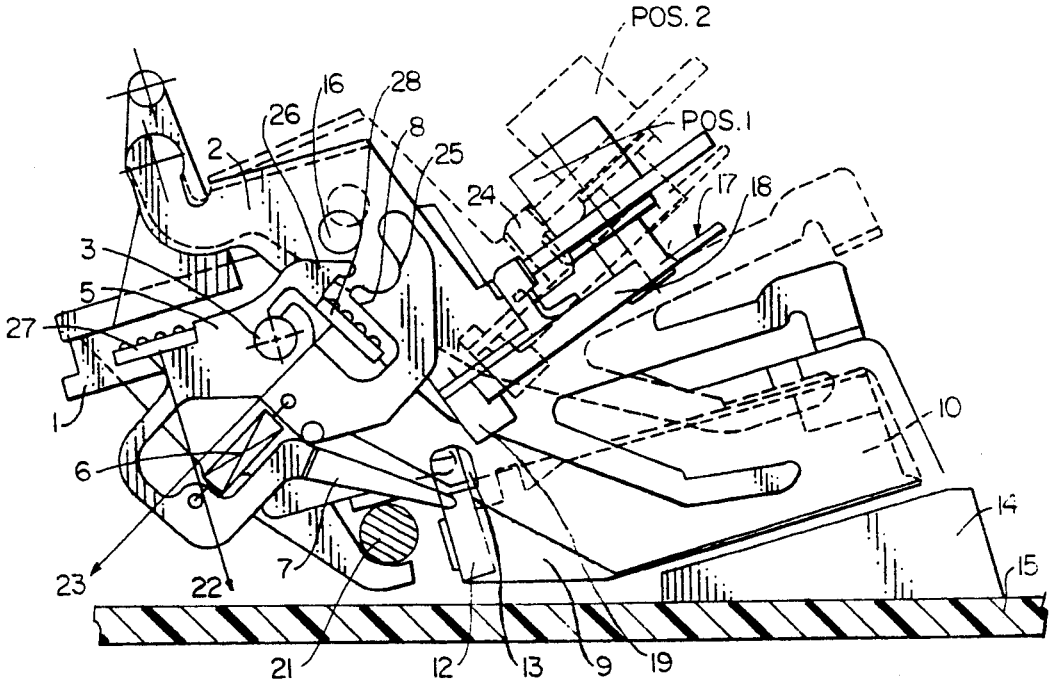
FIG. 2 is a right side elevation view of a carrier, showing the integral locking device, and the correction bail in its resting and correction mode positions.

FIG. 2 is a view of the right side of the carrier (1) in its normal operating condition. The correction bail (2) is shown in both the "at rest" position (Pos. 1) and the correction mode (Pos. 2). The carrier restraint beam means (9) is shown in its retracted or unlocked position and the correction bail restraint means (5) is shown in the unlatched (unlocked) position. The carrier (1) is shown in the unlatched (unlocked) position. The carrier (I) is shown in its permanent position relative to the typewriter base structure (15) and the base pan channel locking feature (14).

By applying downward pressure on tab "a" (27) (see FIG. 2) of the correction bail restraint means (5), the correction bail restraint means (5) pivots counterclockwise on the post (3) on the carrier (1), and the latch (8) of the correction bail restraint means (5) latches onto the stud (16) on the correction bail (2) on the carrier (i). This prevents the correction bail (2) from pivoting up or down, thereby, preventing a correction ribbon (32) mounted in a cartridge (33) from feeding during shipping. The correction bail restraint means (5) is pivotally unlatched from said stud by applying downward pressure on tab "b" (28). 15 The correction bail restraint means (5) (see FIG. 2) has a positive lock and efficient release. The latch (8) of the correction bail restraint means (5) comprises two parts: a. a main C-shaped latch (25), and b. an additional flexible fingerlike latching means (26), wherein, both parts together form a positive lock on the stud (16) and allow efficient release of the latch. Tab "a" (27) is positioned on the correction ribbon restraint means (5), and the surface of tab "a" (27) is angled, so that when downward pressure is applied on the surface of tab "a" (27), a force vector (22) perpendicular to the surface of tab "a", necessary to positively lock the latch (8) of the correction bail restraint means (5) onto the stud (16) on the carrier (1) is created. Tab "b" (28) is positioned on the correction ribbon restraint means (5), and the surface of tab "b" (28) is angled, so that when downward pressure is applied on the surface of tab "b" (28), a force vector (23), perpendicular to the surface of tab "b", necessary to efficiently release the latch (8) of the correction bail restraint means (5) from the stud (16) on the carrier (1) is created.

Figure 3:
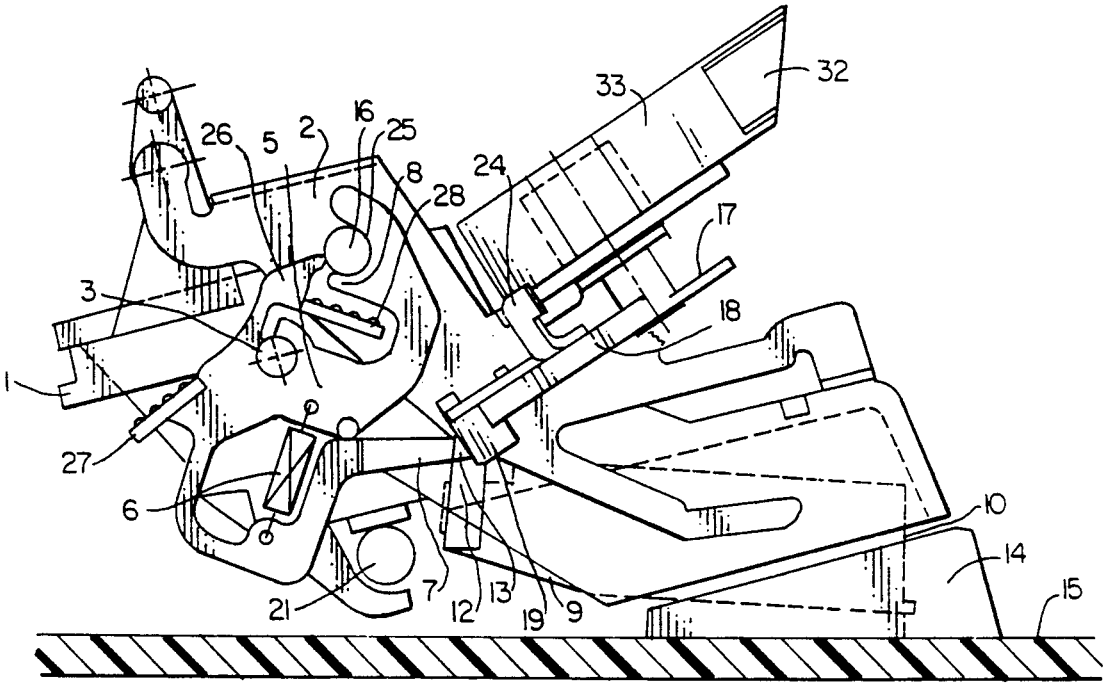
FIG. 3 is a right side elevation view of a carrier, showing the integral locking device in locked relation with the correction bail and a base pan locking channel feature, and blocking a correction ribbon release device.

FIG. 3 is a view of the right side of the carrier (1) showing the integral locking device in the locked position. The correction bail restraint means (5) pivots on the post (3) on the carrier (1), and is shown locked on the stud (16) on the correction bail (2). Locking on the stud (16) on the correction bail (2) prevents the correction bail (2) from pivoting up or down on its own pivot thereby preventing the correction ribbon (32) from feeding during shipping.

The applied downward pressure on tab "a" (27) also pivotally slides the flexible spring arm (7) (see FIGS. 3, 6*a*, 6*b*, and 6*c*) of the correction bail restraint means (5) underneath the carrier restraint beam arm (12), pivotally lifting the carrier restraint beam arm (12), the attached carrier restraint blocking pawl feature means (13) (see FIGS. 6*a*, 6*b*, and 6*c*), and simultaneously pivotally lowering the carrier restraint beam abutment end (10). The blocking pawl feature means (13), in lifted position, acts to block the correction ribbon feed release device (17) (see FIGS. 3 and 4) on the correction bail (2) by contacting the blocking abutment (19) of the tension pawl carrier (18) (see FIG. 4), preventing the tension pawl (24) from contacting the correction bail (2), thereby, jamming the release of the correction ribbon feed releasing device (17) (see FIG. 3). The blocking of the tension pawl carrier (18) is released by the downward pressure on tab "b" (28), which pivotally disengages the correction bail flexible spring arm (7) from the carrier restraint beam arm (12); the carrier restraint beam arm (12) and the blocking pawl feature means (13) are, thereby, pivotally lowered by the pivot spring (4), and the blocking pawl feature means (13) no longer blocks the blocking abutment (19).

A detailed description of the operation of the correction ribbon feed releasing device (17) (see FIG. 4) may be found in U.S. Pat. No. 4,886,385, dated Dec. 12, 1989, invented by Samuel D. Cappotto and assigned to Smith Corona Corporation.

Figure 5:
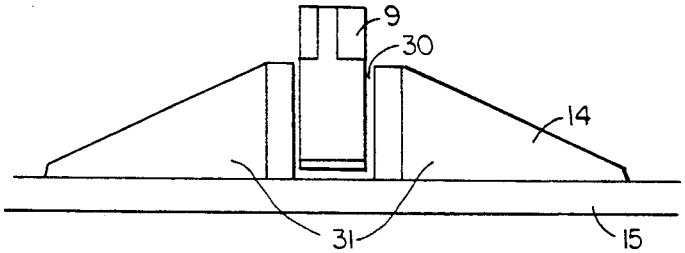
FIG. 5 is a front elevation view of the base pan locking channel feature with a carrier restraint beam means channelled into the base pan channel locking feature.
Figure 6A:
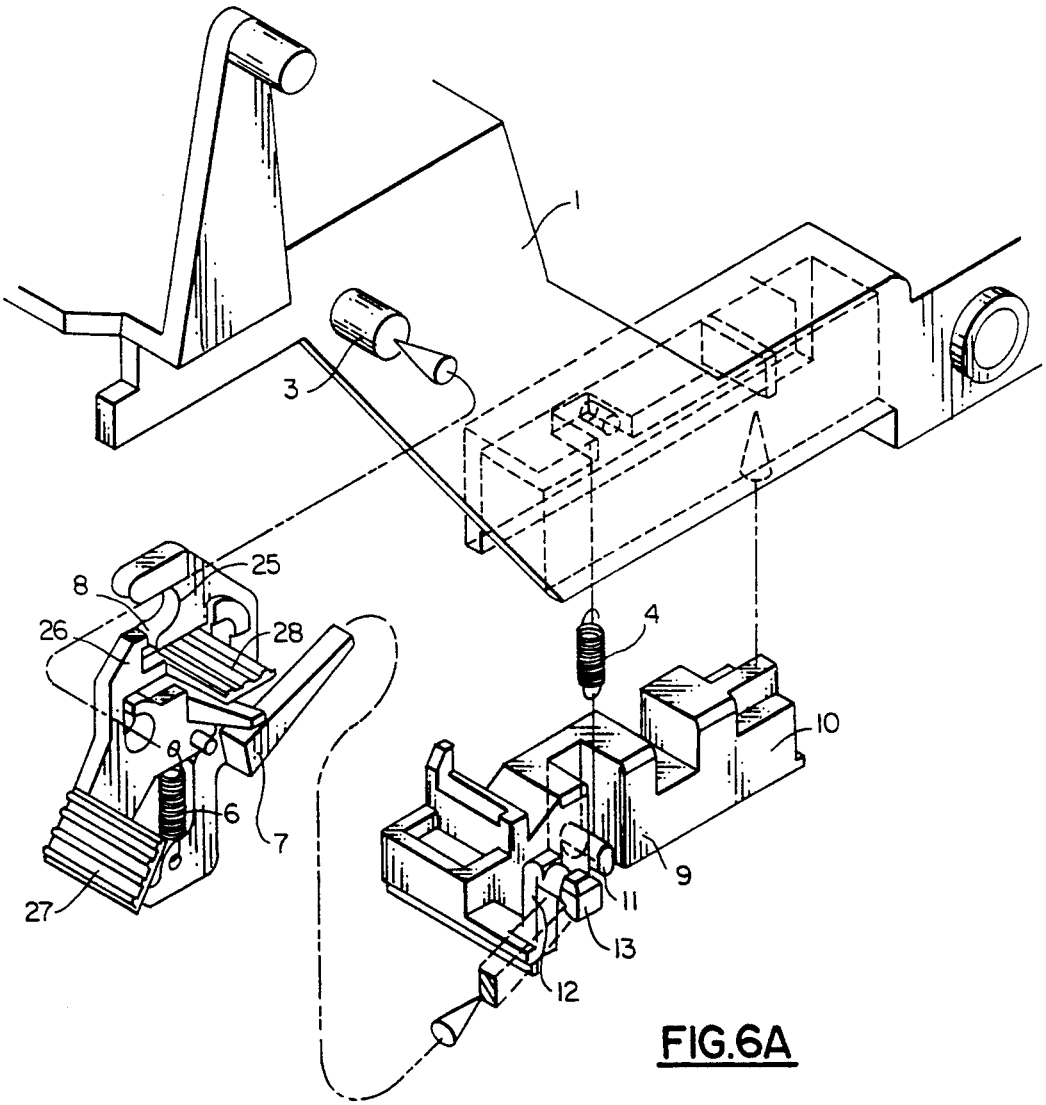
FIG. 6*a* is a back perspective exploded view of the engagement of the correction bail restraint means and the carrier restraint beam means.
Figure 6B:
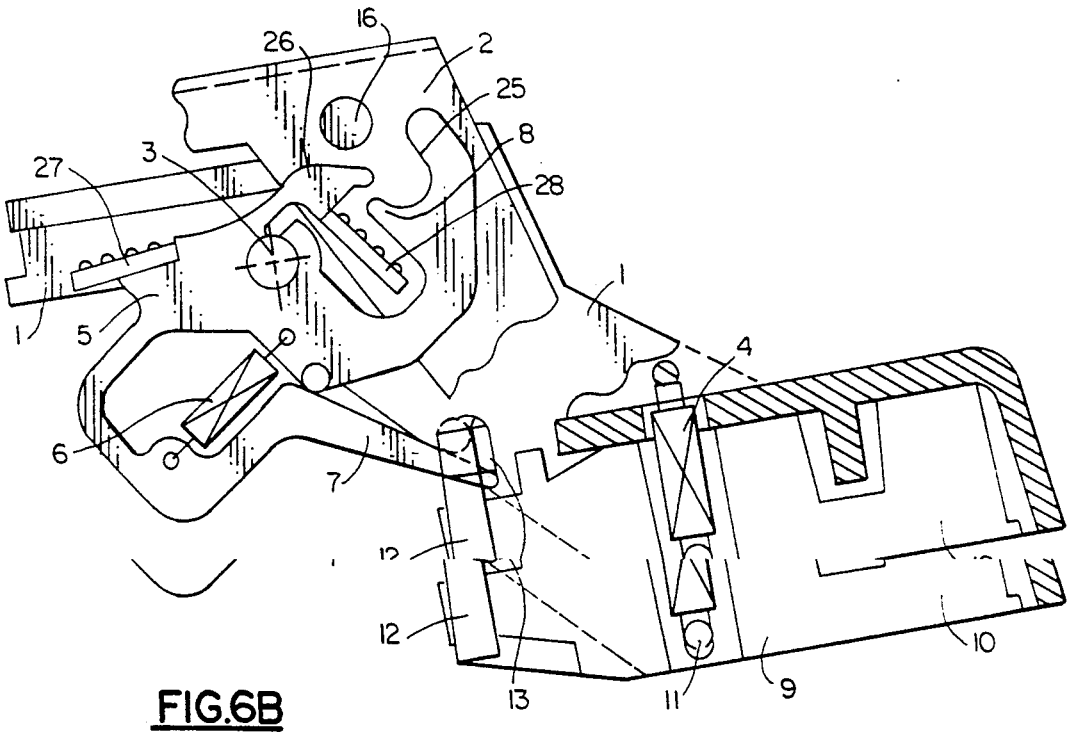
FIG. 6*b* is a right side enlarged, cut-away elevation view of the carrier, and the integral locking device in its unlocked position.
Figure 6C:
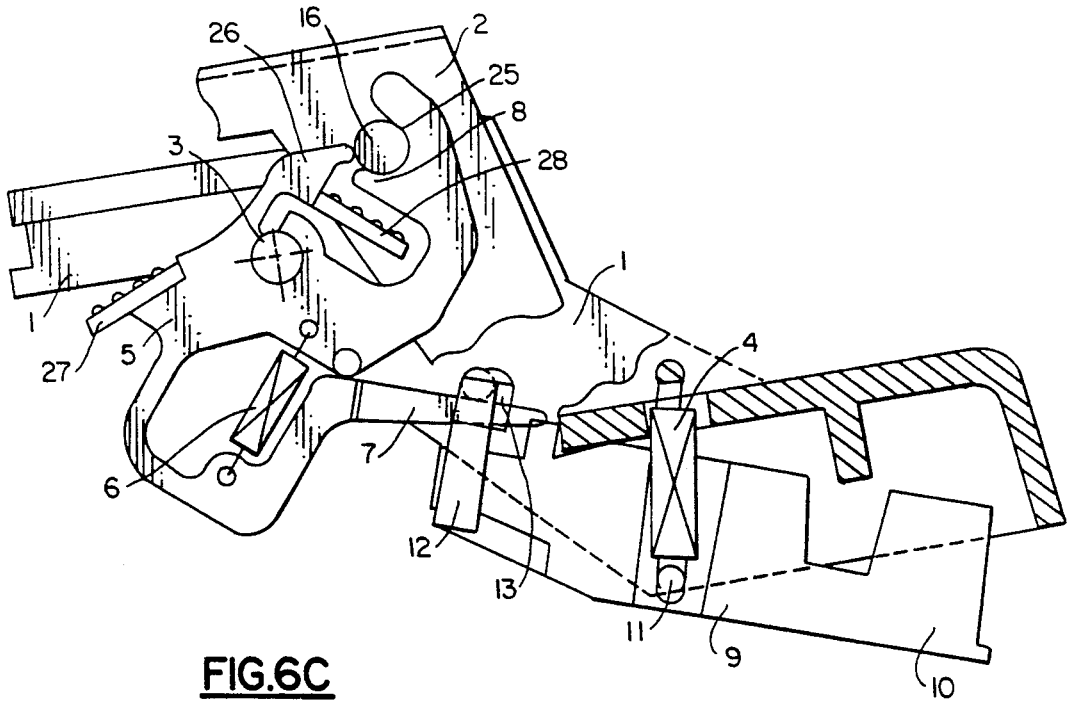
FIG. 6*c* is a right side enlarged, elevation view of the carrier, and the integral locking device in its locked position.

The downward pressure on tab "a" (27) also pivotally positions the carrier restraint beam abutment end (10) in a down position (see FIGS. 6C (to be ramped over the ramping means 31 into the base pan locking channel feature (16). The spring (6) (see FIGS. 6*a*, 6*b*, and 6*c*) of the correction bail restraint means (5) yields and the flexible spring arm (7) is lowered by yielding. Thus, the carrier restraint beam abutment end (10) may be ramped over the ramping means (31) and seated in a channel (30) (see FIG. 5) for locking the carrier (1). The spring (6) (see FIGS. 6*a*, 6*b*, and 6*c*) of the correction bail restraint means (5) supports the flexible spring arm (7); the spring (6) makes certain the flexible spring arm (7) returns to its original position, relative to the correction bail restraint means (5), after the flexible spring arm (7) is released from arm (12). The carrier restraint beam means (10) (see FIG. 3) is disengaged from the base pan locking channel feature (14) by downward pressure on the tab "b" (28), which pivotally disengages the correction bail flexible spring arm (7) from the carrier restraint beam arm (12). The spring (4) simultaneously pivotally lifts the carrier restraint beam abutment end (10) out of the base pan locking channel feature (14), thereby freeing the carrier (1).

Referring to FIGS. 3 and 5, the correction bail restraint latch (8) is engaged by depressing tab "a" (27). This causes the flexible spring arm (7) on the correction bail restraint means (5) (see FIGS. 6*b*) to lift the carrier. restraint beam means (9) into a position where it can be ramped into the base pan locking channel feature (14) when the carrier is moved to the right or left on a rail (21), depending on the position of the carrier (I) relative to the base pan locking channel feature (4) when the carrier restraint abutment end (1) is pivotally lowered.

Figure 8:
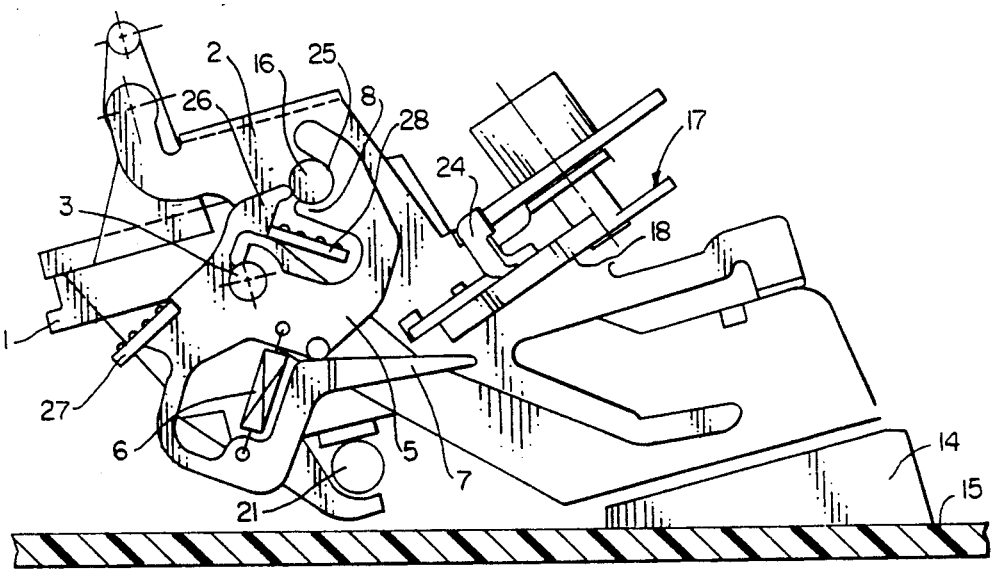
FIG. 8 is a right side elevation view of a carrier without the carrier restraint beam means and showing the correction bail restraint means.

Parts of the above described integral locking device are novel in themselves and may be utilized without each and every part of the preferred embodiment. For example, a locking device for a typewriter, having a moveable carrier (1) (see FIG. 8) and a correction bail (2), pivotally mounted on the carrier (1), to be used during transport of the typewriter, which only locks the correction ribbon bail, may comprise the parts of: a. a pivot post (3) (see FIG. 8) on the carrier (1), b. a correction bail restraint means (5), pivotally mounted on the post (3), including two tabs, "a" (27) and "b" (28), and a latch (8), and c. a stud (16) on the correction bail (2) of the carrier (i). Wherein, by applying downward pressure on tab "a" (27) of the correction bail restraint means (5), the correction bail restraint means (5) pivots on the post (3) on the carrier (i), and the latch (8) of the correction bail restraint means (5) latches onto the stud (16) on the correction bail (2) to prevent the correction bail (2) from pivoting up or down. The correction bail restraint means (5) is pivotally unlatched from the stud (16) by applying downward pressure on tab "b" (28).

Figure 7:
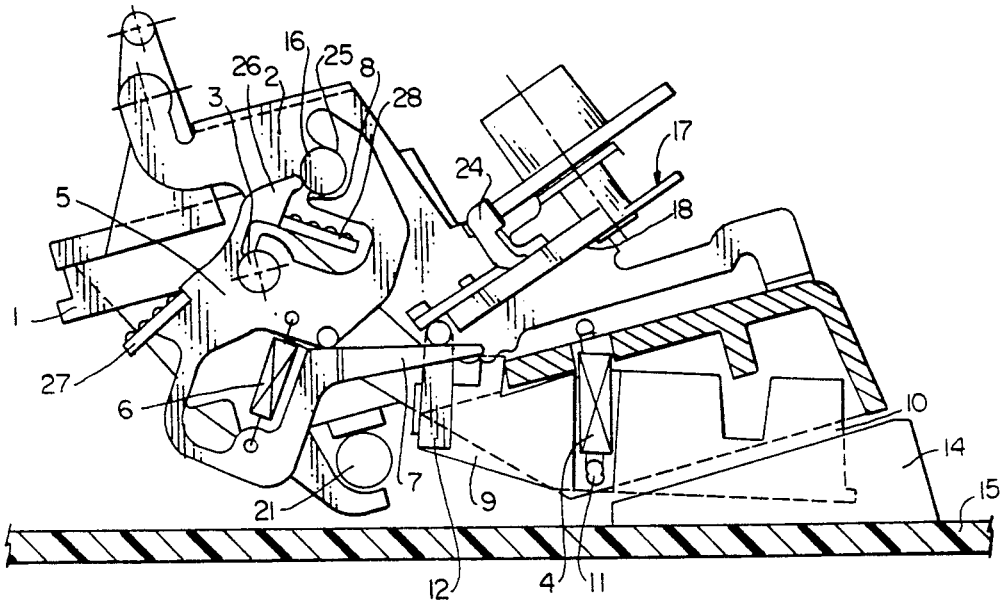
FIG. 7 is a right side elevation view of a carrier showing the integral locking device without a blocking pawl on the carrier restraint beam means and without a blocking feature on the correction ribbon feed release device.

FIG. 7 shows a locking device for a typewriter, having a moveable carrier (1), to be used during transport of the typewriter, which locks the carrier (I) in a predetermined channel position, may comprise the parts of: a. a pivot post (3) on the carrier, b. a pivot spring (4) attached to the carrier (1), c. a correction bail restraint means (5), pivotally mounted on the post (3), including two tabs, "a" (27) and "b" (28), a spring (6), a flexible spring arm (7), and a latch (8), d. a carrier restraint beam means (9), pivotally attached by the pivot spring (4) to the carrier (1), including an abutment end (10), a spring eye pin (II) attached to the pivot spring (4), and an arm (12) on the other end, e. a base pan locking channel feature (14) with ramping means (31) and a channel (30), attached to a typewriter base structure (15) at a predetermined location, and f. a stud (16) on the correction bail (2) on the carrier (1). Wherein, applied downward pressure on tab "a" (27) pivotally slides the flexible spring arm (7) of the correction bail restraint means (5) underneath the carrier restraint beam arm (12), pivotally lifting the carrier restraint beam arm (12), pivotally locking the latch (8) of the correction bail restraint means (2) onto the stud (16) of the carrier (I), and simultaneously pivotally lowering the carrier restraint beam abutment end (10), thereby, positioning the carrier restraint beam abutment end (10) to be ramped into the base pan locking channel feature (14). The spring (6) of the correction bail restraint means (5) yields, and the flexible spring arm (7) is lowered. Thus, the carrier restraint beam abutment end (10) may be ramped over the ramping means (31) and seated in the channel (30) for locking the carrier (I). The abutment end (10) is disengaged from the channel (30) by the downward pressure on tab "b" (28), which pivotally unlatches the latch (8) from the stud (16) and pivotally disengages the flexible spring arm (7) from the carrier restraint beam arm (12). The carrier restraint beam arm (I2) is, thereby, pivotally lowered, and simultaneously the carrier restraint beam abutment end (10) is simultaneously o pivotally lifted out of the channel (30) for freeing the carrier (i).

The above described apparatus is the preferred embodiment for locking a typewriter carrier (1) (see FIG. 7) in a predetermined position; however, the preferred embodiment does not serve as a restriction requirement. For example, placing the stud (16) on the carrier (1) instead of the correction bail, thus, freeing the correction bail (2), does not depart from the scope of the invention.

Figure 9:
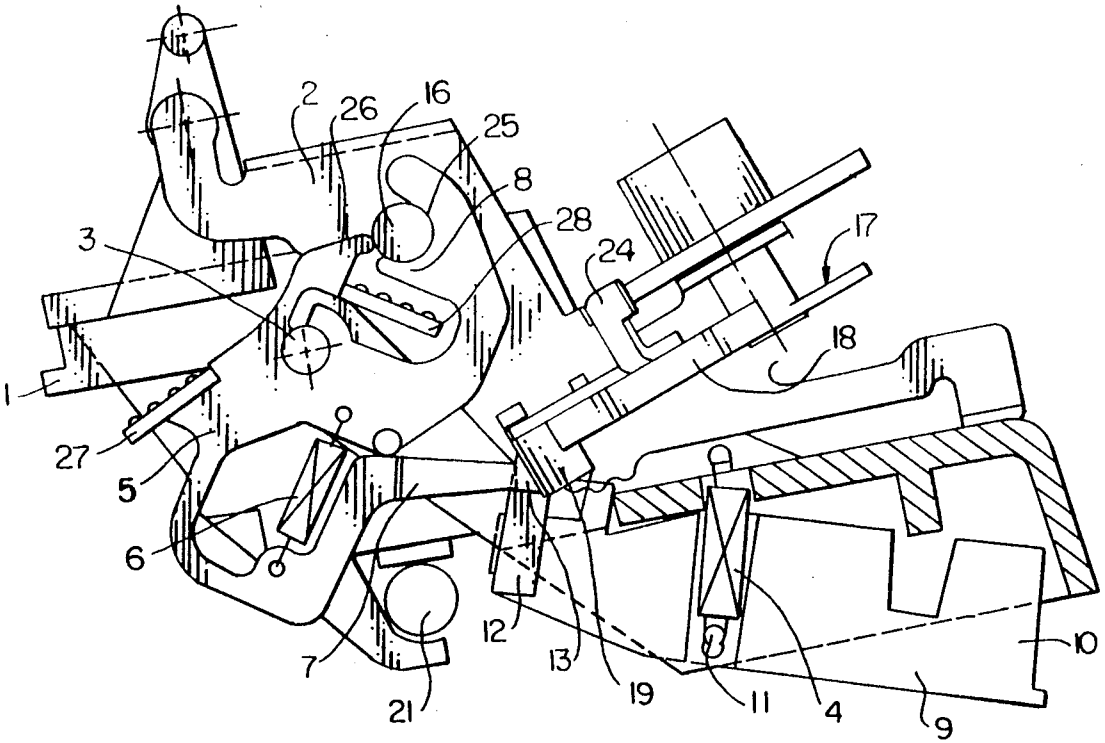
FIG. 9 is a right side elevation view of a carrier showing the integral locking device without the base pan locking channel feature.

FIG. 9 shows a locking device for a typewriter, having a moveable carrier (1) and a correction bail (2) pivotally mounted on the carrier (I), to be used during transport of the typewriter, jams a correction ribbon feed release device (17) on the correction bail (2), in its preferred embodiment, comprises the parts of: a. pivot post (3) on the carrier (I), b. a pivot spring (4) attached to the carrier (1), c. a correction bail restraint means (5), pivotally mounted on the post (3), including two tabs, "a" (27) and "b" (28), a spring (6), a flexible spring arm (7), and a latch (8), d. a carrier restraint beam means (9), pivotally attached by the pivot spring (4) to the carrier (I), including an abutment end (10), a pivot spring eye pin (I1) attached to the pivot spring (4), and an arm (2) and a blocking pawl feature means (13) on the arm (I2) on the other end, e. a stud (16) on the correction bail (2) of the carrier (1), and f. a correction feed ribbon releasing device (17), on the correction bail (2) including a tension pawl carrier (18) (see FIG. 4) with a blocking abutment (19) and a tension pawl (24) on the tension pawl carrier (18). Wherein, applying downward pressure on tab "a" (27) (see FIG. 9) pivotally slides the flexible spring arm (7) of the correction bail restraint means (5) underneath the carrier restraint beam arm (I2) and against the attached carrier restraint blocking feature (13), and pivotally latching the correction bail restraint means latch (8) onto the stud (16), which simultaneously pivotally lowers the carrier restraint beam abutment end (10). Thereby, the blocking pawl feature means (13), in lifted pivot position, acts to block the correction ribbon feed release device (17) on the correction bail (2) by contacting the blocking abutment (19) (see FIG. 4) of the tension pawl carrier (18) for preventing the tension pawl (24) from contacting the correction bail (2), which prevents the correction ribbon (32) from feeding. The jamming of the tension pawl carrier (18), is released by the downward pressure on tab "b" (28) (see FIG. 9), which pivotally unlatches the correction bail restraint means (5) and pivotally disengages the correction bail flexible spring arm (7) from the carrier restraint beam arm (12). The carrier restraint beam arm (12) and the blocking pawl feature means (13) are, thereby, pivotally lowered, and the blocking pawl feature (13) no longer blocks the blocking abutment (19).

The above described apparatus is the preferred embodiment for jamming the correction ribbon releasing device (17) (see FIG. 9); however, the preferred embodiment does not serve as a restriction requirement. For example, placing the stud (16) on the carrier (i) instead of the correction bail (2), thus unlocking the correction bail (2), does not depart from the scope of the invention.

The foregoing description has been directed to particular embodiments of the invention in accordance with the requirements of the Patent Statutes for the purposes of illustration and explanation. It will become apparent, however, to those skilled in the art that many modifications and changes will be possible without departure from the scope and spirit of the invention. It is intended that the following claims be interpreted to embrace all such modifications.

What is claimed is:

1. A locking device for a typewriter for use during transport thereof, the typewriter having a moveable carrier, a correction bail pivotally mounted on said carrier, and a correction ribbon mounted on said correction bail, said locking device comprising:

a. a correction bail restraint means mounted on said carrier and operable from a rest position to an actuated position for latching said correction bail on said carrier to prevent pivotable movement of said correction bail for preventing feeding said correction ribbon;

b. an arm carried by said correction bail restraint means; and c. a carrier restraint beam means mounted on the carrier and engaged by said arm wherein said arm moves said carrier restraint beam means from a rest position to an actuated position for locking said carrier in a predetermined position in response to operating said correction bail restraint means to said actuated position and in response to moving said carrier to said predetermined position.

2. The locking device of claim 1 further comprising:

c. a correction ribbon feed releasing device mounted on said correction bail; and d. a blocking abutment mounted on said correction ribbon feed releasing device for engaging said carrier restraint beam means when said carrier restraint beam means is in said actuated position to prevent feeding of said correction ribbon, and said blocking abutment avoids engaging said carrier restraining beam means when said carrier restraint beam means is in said rest position to permit feeding of said correction ribbon.

3. The locking device of claim 1, wherein the typewriter further having a base pan locking channel feature and said carrier restraint beam means comprises:

a. a pivot spring;

b. a pivot spring eye pin;

c. an abutment end; and d. an arm on the other end, wherein, said carrier restraint pivot spring eye pin is pivotally attached by said pivot spring to said carrier, and by pivotally lifting said carrier restraint beam arm, said carrier restraint beam abutment end is positioned to be ramped into said base pan locking channel feature; and depressing said arm disengages said abutment from said base pan locking channel feature, thereby allowing longitudinal movement of said carrier.

4. The locking device of claim 3, wherein said correction bail restraint means comprises:

a. a post mounted on said carrier;

b. a stud mounted on said correction bail;

c. a latch mounted on said correction restraint means and located on a first side of said post;

d. a tab "a" mounted on said carrier bail restraint means and located on a second side of said post; and e. a tab "b" mounted on said correction bail restraint means and located on said first side of said post, wherein, said correction bail restraint means is pivotally mounted on said post, said latch pivotally latches onto said stud by applying downward pressure on said tab "a" preventing said correction bail from pivoting up and down, and said latch is pivotally unlatched from said stud by applying downward pressure on said tab "b".

5. The locking device of claim 4, wherein said arm carried by said correction bail restraint means is a flexible spring arm for movement relative thereto and wherein said correction bail restraint means further comprises:

f. a spring connected to said flexible spring arm and to said correction bail restraint means for biasing said flexible spring arm upwardly, wherein applying downward pressure on said tab "a" pivotally lifts said flexible spring arm for lifting said carrier restraint beam arm which lowers said carrier restraint beam abutment end to be ramped and biased into said base pan channel locking feature, said spring yields and said flexible spring arm is lowered for allowing said abutment end to be ramped for locking said carrier; and applying downward pressure on said tab "b" disengages said flexible spring arm from said carrier restraint beam arm for releasing said abutment end from engagement with said base pan locking channel feature.

6. The locking device of claim 4 wherein said latch includes a main C-shaped latch and an additional flexible finger-like latching means, and said main C-shaped latch and additional flexible finger-like latching means together form a positive lock on said stud and allows efficient release of said C-shaped latch.

7. The locking device of claim 4 wherein said tab "a" is positioned and angled, so that when downward pressure is applied on the surface of aid tab "a", a force vector in a direction of an arrow 22, necessary to positively lock said latch of said correction bail restraint means onto said stub on said carrier, is created.

8. The locking device of claim 4 wherein said tab "b" is positioned and angled, so that when downward pressure is applied on the surface of said tab "b", a force vector in a direction of an arrow 23, necessary to efficiently release said latch of said correction bail restraint means from said stud on said carrier, is created.

9. A locking device for a typewriter for use during transport thereof, the typewriter having a moveable carrier, a correction bail pivotally mounted on said carrier, and a correction ribbon mounted on said correction bail, said locking device comprising:

a. a correction bail restraint means including a latch mounted on said carrier and manually operable from a rest position to an actuated position; and b. said latch includes two parts for positively latching said correction bail on said carrier when said correction bail restraint means is in said actuated position to prevent pivotable movement of said correction bail for preventing feeding said correction ribbon.

10. The locking device of claim 9, wherein said correction bail restraint means comprises:

a. a post mounted on said carrier;

b. a stud mounted on said correction bail;

c. a latch mounted on said correction bail restrain means and located on a first side of said post;

d. a tab "a" mounted on said correction bail restraint means and located on a second side of said post; and e. a tab "b" mounted on said correction bail restraint means and located on said first side of said post, wherein, said correction bail restraint means is pivotally mounted on said post, said latch pivotally latches onto said stud by applying downward pressure on said tab "a" for preventing said correction bail from pivoting up and down, and said latch is pivotally unlatched from said stud by applying downward pressure on said tab "b".

11. The locking device of claim 10 wherein said latch includes a main C-shaped latch and an additional flexible finger-like latching means, and said main C-shaped latch and additional flexible finger-like latching means together form a positive lock on said stud and allows efficient release of said C-shaped latch.

12. The locking device of claim 10 wherein said tab "a" is positioned and angled, so that when downward pressure is applied on the surface of said tab "a", a force vector in a direction of an arrow 22, necessary to positively lock said latch of said correction bail restraint means onto said stud on said carrier, is created.

13. The locking device of claim 10 wherein said tab "b" is positioned and angled, so that when downward pressure is applied on the surface of said tab "b", a force vector in a direction of an arrow 23, necessary to efficiently release said latch on said correction bail restraint means from said stud on said carrier, is created.

14. A locking device for a typewriter for use during transport thereof, the typewriter having a moveable carrier, a correction bail pivotally mounted on said carrier, and a correction ribbon mounted on said correction bail, said locking device comprising:

a. a correction bail restraint means mounted on said carrier and operable from a rest position to an actuated position;

b. an arm carried by said correction bail restraint means; and c. a carrier restraint beam means engaged by said arm causing said arm to move said carrier restraint beams from a rest position to an actuated position for locking said carrier in a predetermined position in response to operating said correction bail restraint means to said actuated position and in response to moving said carrier to said predetermined position.

15. The locking device of claim 14, wherein the typewriter further having a base pan locking channel feature and said carrier restraint beam means comprises:

a. a pivot spring;

b. a pivot spring eye pin;

c. an abutment end; and d. an arm on the other end, wherein, said carrier restraint pivot spring eye pin is pivotally attached by said pivot spring to said carrier, and by pivotally lifting said carrier restraining beam arm, said carrier restraint beam abutment end is positioned to be ramped into said base pan locking channel feature; and depressing said arm disengages said abutment from said base pan locking channel feature, thereby allowing longitudinal movement of said carrier.

16. The locking device of claim 15, wherein said correction bail restraint means comprises:

a. a post mounted on said carrier;

b. a stud mounted on said correction bail;

c. a latch mounted on said correction bail restraint means and located on a first side of said post;

d. a tab "a" mounted on said correction bail restraint means and located on a second side of said post; and e. a tab "b" mounted on said correction bail restraint means and located on said first side of said post, wherein, said correction bail restraint means is pivotally mounted on said post, said latch pivotally latches onto said stud by applying downward pressure on said tab "a" for preventing said correction bail from pivoting up and down, and said latch is pivotally unlatched from said stud by applying downward pressure on said tab "b".

17. The locking device of claim 16, wherein said arm carried by said correction bail restraint means is a flexible spring arm for movement relative thereto and wherein said correction bail restraint means further comprises:

f. a spring connected to said flexible spring arm and to said correction bail restraint means for biasing said flexible spring arm upwardly, wherein applying downward pressure on said tab "a" pivotally lifts said flexible spring arm for lifting said carrier restraint beam arm which lowers said carrier restraint beam abutment end to be ramped and biased into said base pan channel locking feature, said spring yields and said flexible spring arm is lowered for allowing said abutment end to be ramped for locking said carrier; and applying downward pressure on said tab "b" disengages said flexible spring arm from said carrier restraint beam arm for releasing said abutment end from engagement with said base pan locking channel feature.

18. The locking device of claim 16 wherein said latch includes a main C-shaped latch and an additional flexible finger-like latching means, and said main C-shaped latch and additional flexible finger-like latching means together form a positive lock on said stud and allows efficient release of said C-shaped latch.

19. The locking device of claim 16 wherein said tab "a" is positioned and angled, so that when downward pressure is applied on the surface of said tab "a", a force vector in a direction of an arrow 22, necessary to positively lock said latch of said correction bail restraint means onto said stud on said carrier, is created.

20. The locking device of claim 16 wherein said tab "b" is positioned and angled, so that when downward pressure is applied on the surface of said tab "b", a force vector in a direction of an arrow 23, necessary to efficiently release said latch of said correction bail restraint means from said stud on said carrier, is created.

21. A locking device for a typewriter for use during transport thereof, the typewriter having a moveable carrier, a correction bail pivotally mounted on said carrier, and a correction ribbon mounted on said correction bail, said locking device comprising:

a. a correction bail restraint means mounted on said carrier and operable from a rest position to an actuated position;

b. an arm carried by said correction bail restraint means;

c. a correction ribbon feed releasing device mounted on said correction bail which includes a tension pawl carrier and a blocking abutment on said tension pawl carrier;

d. a carrier restraint beam means mounted on said carrier and engaged by said arm causing said arm to move said carrier restraint beam means from a rest position to an actuated position; and e. a blocking pawl feature means mounted on said carrier restraint beam means for preventing feeding of said correction ribbon by jamming said blocking abutment in response to said carrier restraint beam means being moved to said actuated position by said arm.

22. The locking device of claim 21, wherein the typewriter further having a base pan locking channel feature and said carrier restraint beam means comprises:

a. a pivot spring;

b. a pivot spring eye pin;

c. an abutment end; and d. an arm on the other end, wherein, said carrier restraint pivot spring eye pin is pivotally attached by said pivot spring to said carrier, and by pivotally lifting said carrier restraint beam arm, said carrier restraint beam abutment end is positioned to be ramped into said base pan locking channel feature; and depressing said arm disengages said abutment from said base pan locking channel feature, thereby allowing longitudinal movement of said carrier.

23. The locking device of claim 22, wherein said correction bail restraint means comprises:

a. a post mounted on said carrier;

b. a stud mounted on said correction bail;

c. a latch mounted on said correction bail restraint means and located on a first side of said post;

d. a tab "a" mounted on said correction bail restraint means and located on a second side of said post; and e. a tab "b" mounted on said correction bail restraint means and located on said first side of said post, wherein, said correction bail restraint means is pivotally mounted on said post, said latch pivotally latches onto said stud by applying downward pressure on said tab "a" for preventing said correction bail from pivoting up and down, and said latch is pivotally unlatched from said stud by applying downward pressure on said tab "b".

24. The locking device of claim 23 wherein said arm carried by said correction bail restraint means is a flexible spring arm for movement relative thereto and wherein said correction bail restraint means further comprises:

f. a spring connected to said flexible spring arm and to said correction bail restraint means for biasing said flexible spring arm upwardly, wherein applying downward pressure on said tab "a" pivotally lifts said flexible spring arm for lifting said carrier restraint beam arm and said blocking pawl feature means for jamming said blocking abutment for preventing feeding said correction ribbon; and applying downward pressure on said tab "b" pivotally lowers said flexible spring arm, said flexible spring arm disengages said carrier restraint beam arm, thereby lowering said blocking pawl feature means and unjamming said blocking abutment for allowing feeding said correction ribbon.

25. The locking device of claim 23 wherein said latch includes a main C-shaped latch and an additional flexible finger-like latching means, and said main C-shaped latch and additional flexible finger-like latching means together form a positive lock on said stud and allows efficient release of said C-shaped latch.

26. The locking device of claim 23 wherein said tab "a" is positioned and angled, so that when downward pressure is applied on the surface of said tab "a", force vector in a direction of an arrow 22, necessary to positively lock said latch of said correction bail restraint means onto said stud on said carrier, is created.

27. The locking device of claim 23 wherein said tab "b" is positioned and angled, so that when downward pressure is applied on the surface of said tab "b", a force vector in a direction of an arrow 23, necessary to efficiently release said latch of said correction bail restraint means from said stud on said carrier, is created.

28. A method of locking typewriters for use during transport thereof, the typewriter having a moveable carrier, a correction bail pivotably mounted on said carrier, and a correction ribbon mounted on said correction bail, comprising the steps of:

a. latching said correction bail on said carrier to prevent pivotable movement of said correction bail for preventing feeding said correction ribbon;

b. actuating an arm in response to latching said correction bail; and c. locking said carrier in a predetermined position in response to actuating said arm.

29. The method of claim 28 wherein the typewriter further having a correction ribbon feed release means, further comprising the step of jamming said correction ribbon feed release means in response to actuating said arm for preventing feeding said correction ribbon.

* * * * *